United States Patent [19]

Chalberg et al.

[11] Patent Number: 4,901,379

[45] Date of Patent: Feb. 20, 1990

[54] AIR EXCITATION HYDROMASSAGE SYSTEM

[75] Inventors: Philip E. Chalberg, Costa Mesa; James P. McKnight, El Toro, both of Calif.

[73] Assignee: Hydrabaths, Inc., Santa Ana, Calif.

[21] Appl. No.: 185,919

[22] Filed: Apr. 25, 1988

[51] Int. Cl.[4] ..... A61H 33/02

[52] U.S. Cl. ..... 4/543; 4/541; 239/445; 239/581.1

[58] Field of Search ..... 4/492, 538, 541, 542, 4/543, 567–570, 559; 128/66, 365, 369; 239/444, 445, 443, 562, 581.1

[56] References Cited

U.S. PATENT DOCUMENTS

| | | | |
|---|---|---|---|
| 2,313,994 | 3/1943 | Grant | 239/444 |
| 4,207,877 | 6/1980 | Marquardt | 128/66 |
| 4,264,039 | 4/1981 | Moreland | 4/542 |
| 4,340,039 | 7/1982 | Hibbard et al. | 4/542 |
| 4,398,669 | 8/1983 | Fienhold | 239/562 |
| 4,419,775 | 12/1983 | Ebert | 4/541 |
| 4,672,692 | 6/1987 | Savage | 4/543 |

FOREIGN PATENT DOCUMENTS

| | | | |
|---|---|---|---|
| 1224308 | 3/1971 | United Kingdom . | |
| 1460206 | 12/1976 | United Kingdom . | |
| 1496613 | 12/1977 | United Kingdom . | |
| 2026317 | 2/1980 | United Kingdom . | |
| 1604587 | 12/1981 | United Kingdom . | |
| 2107180 | 4/1983 | United Kingdom . | |
| 2112670 | 7/1983 | United Kingdom | 4/542 |
| 2114021 | 8/1983 | United Kingdom . | |
| 2120546 | 12/1983 | United Kingdom . | |
| 2159404 | 12/1985 | United Kingdom . | |
| 2161072 | 1/1986 | United Kingdom . | |
| 2169799 | 7/1986 | United Kingdom . | |

*Primary Examiner*—Renee S. Luebke
*Assistant Examiner*—J. Casimer Jacyna
*Attorney, Agent, or Firm*—Leonard Tachner

[57] ABSTRACT

An air excitation bath system designed to produce a hydromassage effect in, for example, an ordinary bathtub. The system utilizes an air control serial array of adjustable nozzle assemblies preferably installed on the bottom of the tub to provide the user with means for adjusting the rate and direction of the air flow through the water to massage different parts of the body. The air control system is characterized by at least one and preferably two or more serial arrays of adjustable nozzle assemblies. Each such array is serially interconnected by a plurality of flexible hoses. The respective arrays are interconnected, preferably to a common flexible hose which is in turn connected to an air blower through at least one safety loop and a check valve. Each nozzle assembly is provided with a cap, a body and a foot as well as an additional check valve located between the cap and the body. The cap and the body are specially configured to permit adjustability of air flow from either substantially off to substantially full flow and also provide means for directing air flow laterally along the surface of the floor of the tub and/or vertically toward the top surface of the water. An especially novel feature of the present invention is the design of a nozzle foot which is positioned beneath the tub floor and is provided with a unique low profile configuration to substantially minimize the space required beneath the tub.

8 Claims, 6 Drawing Sheets

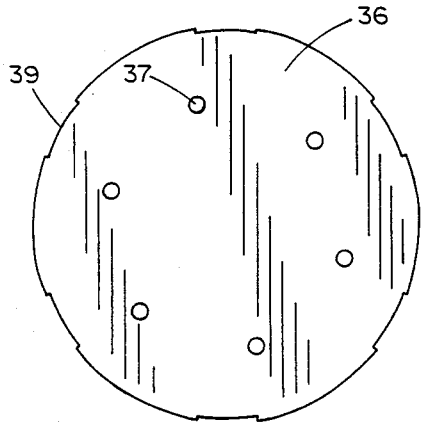
FIG. 3
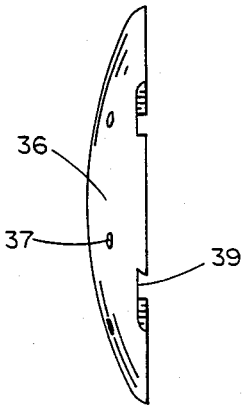
FIG. 4
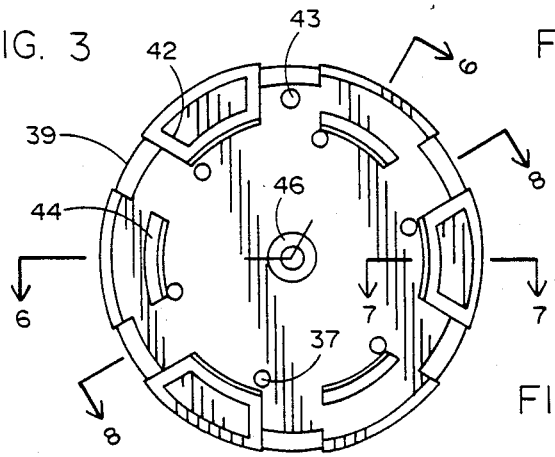
FIG. 5
FIG. 6
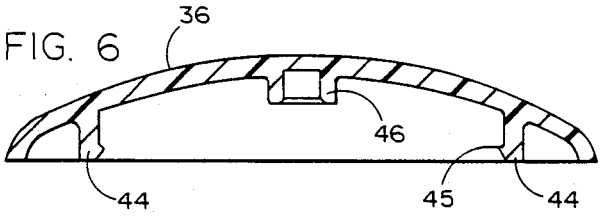
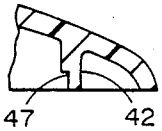
FIG. 7
FIG. 8
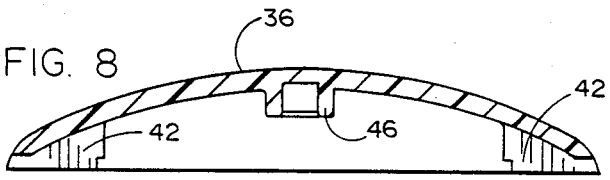

AIR EXCITATION HYDROMASSAGE SYSTEM

BACKGROUND OF THE INVENTION

1. Field of the Invention

The present invention relates generally to hydromassage bath systems and more particularly, to such systems wherein air is expelled from a plurality of jets mounted on the wall of a bathtub for activating the water into a massaging action on the user therein.

2. Prior Art

The use of a hydromassage as a means for relieving fatigued muscles and soothing the aches and pains of physical injuries is certainly well-known in the prior art. Most hydromassage systems known in the United States are of the type which employ a plurality of venturi jets which mix air and water utilizing a high speed flow of water to suction air into the mixture. An altogether different type of hydromassage system has become popular, primarily in Europe and this European system relies entirely on the injection of air such as into a bath full of water. One of the advantages of a system which uses only air is that it tends to be simpler and less costly to manufacture and therefore more readily available to the general public at lower cost while still providing beneficial hydromassage effects. Typical air injection systems force air through a plurality of exit ports mounted within a tub to activate the water and massage the user. Because of the differences in the behavior of air bubbles injected into a bathtub full of water as compared to a mixture of air and water and particularly, high pressure water, it is preferable in air injection systems to use a large plurality of injection ports preferably at the bottom of the tub as opposed to the side walls of the tub. Unfortunately, the process of connecting an air hose to each of a plurality of inlet ports at the bottom of a tub can become quite complex and expensive thereby defeating the otherwise advantageous simplicity of using only air instead of a combination of air and water. For example, one prior art air injection system uses an air manifold in which a separate parallel pipe connection is provided to each of a large plurality of air injector ports. Another prior art system requires placing an inner tub surface inside the existing tub surface in order to facilitate installation of a plurality of jets between the floor of the original tub and the floor of the newly inserted tub. Still another prior art system requires the use of exotic bathtub structures which substantially preclude modification of an existing bathtub structure and thus significantly increases the cost of the overall system. Still an additional prior art system utilizes a special air bubble-generating mat that must be manually placed inside the bathtub each time the system is to be used, thereby reducing the comfort and convenience of the hydromassage concept.

The use of expensive, specially constructed bathtubs and the use of very complicated hose manifold systems substantially increase the overall cost of installing an air bubble injection hydromassage system, commercially limiting the success of an otherwise advantageous, simple concept of injecting only air into a bathtub. In addition, a substantial, if not major portion of the market for such hydromassage systems resides in modification of existing bathtubs as opposed to installing new bathtubs. Many of the prior art systems available in Europe are simply incompatible with the concept of modifying an existing bathtub and those that are compatible require such extensive hose manifolds that it becomes prohibitively expensive to modify an existing bathtub even when it is physically possible to do so.

There is therefore a need for an air injection hydromassage system which exploits rather than defeats the lower-cost, simpler use of only air to inject into a bathtub to create the hydromassage effect. There is simultaneously a need for a system of that type which provides many of the advantages currently available in air and water venturi systems currently in use in the United States. Thus for example, it would be highly advantageous to also provide an air injection system which permits the user to vary the force of water activation on a jet-by-jet basis thereby permitting each user to modify the massage effect in accordance with his own personal preferences and the desire to massage one or more body parts to a greater extent than others.

The most relevant prior art known to the applicants is disclosed in U.K. Patent application No. 2,114,021A published Aug. 17, 1983. While this disclosure describes an air injection apparatus which solves some of the aforementioned needs, it suffers from two significant disadvantages to which the present invention is directed. First and foremost, the aforementioned in U.K. patent application discloses system which requires a substantial vertical space beneath the floor of the tub to interconnect a plurality of nozzle assemblies. Secondly, the disclosed system fails to provide any means for permitting the user to control the force and direction of air flow out of the nozzles and into the bathtub.

Other relevant prior art includes the following British patents:

1,224,308 Jacuzzi
1,460,206 Jacuzzi
1,496,613 Kulisch
1,604,587 May
2,026,317A Dupont
2,107,180A Price et al
2,114,021A Randle
2,120,546A Carr
2,159,404A Brueton
2,161,072A Brueton
2,169,799A Tennant

SUMMARY OF THE INVENTION

The aforementioned need is solved by means of the present invention which provides a unique air injection hydromassage system utilizing one or more serial interconnections of adjustable air nozzles each of which may be varied to control the level of air flow into the tub as well as the direction of air into the tub through that nozzle. While installation of the present invention requires drilling holes through the floor of the tub, the low profile components of the present invention, as well as the simple interconnection scheme thereof, simplifies installation and reduces the number of separate components. Such distinct advantages reduce the overall cost of modifying an existing tub to incorporate the air injection system of the present invention. Furthermore, the present invention obviates the need for complex air manifold control systems, extensive air flow piping and the need for specially constructed tub structures which must be used in some prior art systems to accommodate air injection installations. Furthermore, the present invention, once installed, is a permanent system which does not require a user to manually place a mat or any other extraneous structure into the bottom of the tub before using same.

Each of the novel nozzles of the present invention is a three-part structure comprising a nozzle cap, a nozzle body and a nozzle foot. Only the nozzle cap and the uppermost castellated portion of the nozzle body extend above the tub floor, but are configured to be extremely low profile to minimize any risk of discomfort or injury to the user. By simply rotating the nozzle cap of the present invention, one can readily control the air flow direction and force on a nozzle-by-nozzle basis thereby modifying the water agitation to accommodate each user's preferences. The nozzle foot is a uniquely configured low profile, high compression strength structure which permits installation in most cases without permanently altering the position of the tub. Furthermore, the nozzle foot configuration permits interconnection in a serial arrangement using flexible hose connected to a remotely positioned air blower activated by a pneumatic control which may be mounted in a side wall of the bathtub thereby obviating any possibility of electric shock.

OBJECTS OF THE INVENTION

It is therefore a principal object of the present invention to provide a unique air injection hydromassage system which generally preserves the cost advantageous simplicity of a hydromassage system using only air injection by providing a serial array of interconnected air nozzles easily installed into the bottom surface of a tub and connected to a common air blower while obviating the prior art requirement for complex manifold systems.

It is an additional object of the present invention to provide an air injection hydromassage system having a plurality of manually adjustable air injection nozzles which can be easily controlled by the user to modify the force and direction of the air flow to control the agitation produced by the system.

It is still an additional object of the present invention to provide an air injection hydromassage system which may be readily installed into existing bathtub structures with a minimum of inconvenience and cost thereby exploiting the cost saving simplicity of hydromassage units which use only air as opposed to a mixture of air and water.

It is still an additional object of the present invention to provide an improved air injection hydromassage system which uses a plurality of serially interconnected adjustable air injection nozzles each of a unique low profile configuration which may be readily installed into the floor of a conventional tub and wherein one or more of such serial arrays may be interconnected to a common air blower positioned exterior to the tub controlled by the user from within the tub.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which:

FIG. 3 is a top view of the nozzle cap of the present invention;

FIG. 4 is a side view of the nozzle cap of the present invention;

FIG. 5 is a bottom view of the nozzle cap of the present invention;

FIG. 6 is a cross-sectional view of the nozzle cap of the present invention taken along lines 6—6 of FIG. 5;

FIG. 7 is a partial cross-section view of a portion of the nozzle cap of the invention taken along lines 7—7 of FIG. 5;

FIG. 8 is a cross-sectional view of the nozzle cap of the invention taken along lines 8—8 of FIG. 5;

DETAILED DESCRIPTION OF A PREFERRED EMBODIMENT

Figure 1:
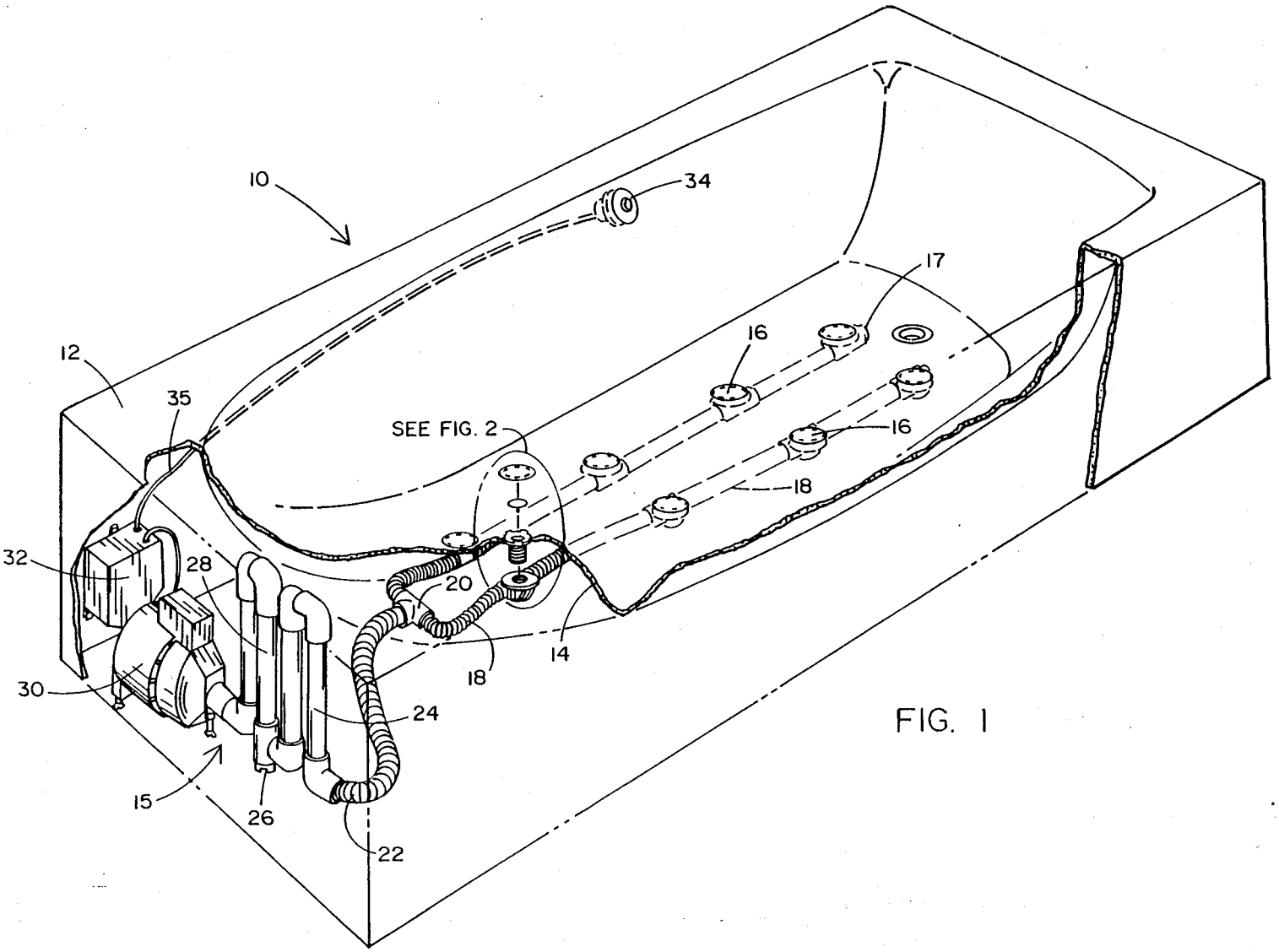
FIG. 1 is an isometric schematic illustration of an entire system using the present invention.

Referring now to FIG. 1 it will be seen that the air excitation bath system 10 of the present invention comprises a bathtub 12 having a tub floor 14 into which is mounted the air control system 15 of the present invention. The air control system 15 comprises a plurality of nozzle assemblies 16 interconnected by a plurality of flexible hoses 18. In the particular embodiment illustrated in FIG. 1 there are two serial arrays of nozzle assemblies 16, each such array interconnected by serial flexible hoses 18. The two serial arrays are interconnected at a common tee 20 which is in turn connected by a larger flexible hose 22 to a blower 30 by means of a first safety loop 24 and a second safety loop 28, the latter including a check valve 26. Blower 30 is provided with a blower control 32 to which is connected a control button 34 by means of a pneumatic line 35. It should be understood that although two serial arrays of nozzle assemblies are shown in FIG. 1 whereby the entire air control system comprises a total of eight nozzle assemblies 16, the actual number of serial arrays and the actual number of nozzle assemblies may be varied depending upon the particular configuration desired for a given bathtub and the preferences of a given user. Accordingly, the precise number and location of nozzle assemblies is not to be deemed limiting of the present invention.

Figure 2:
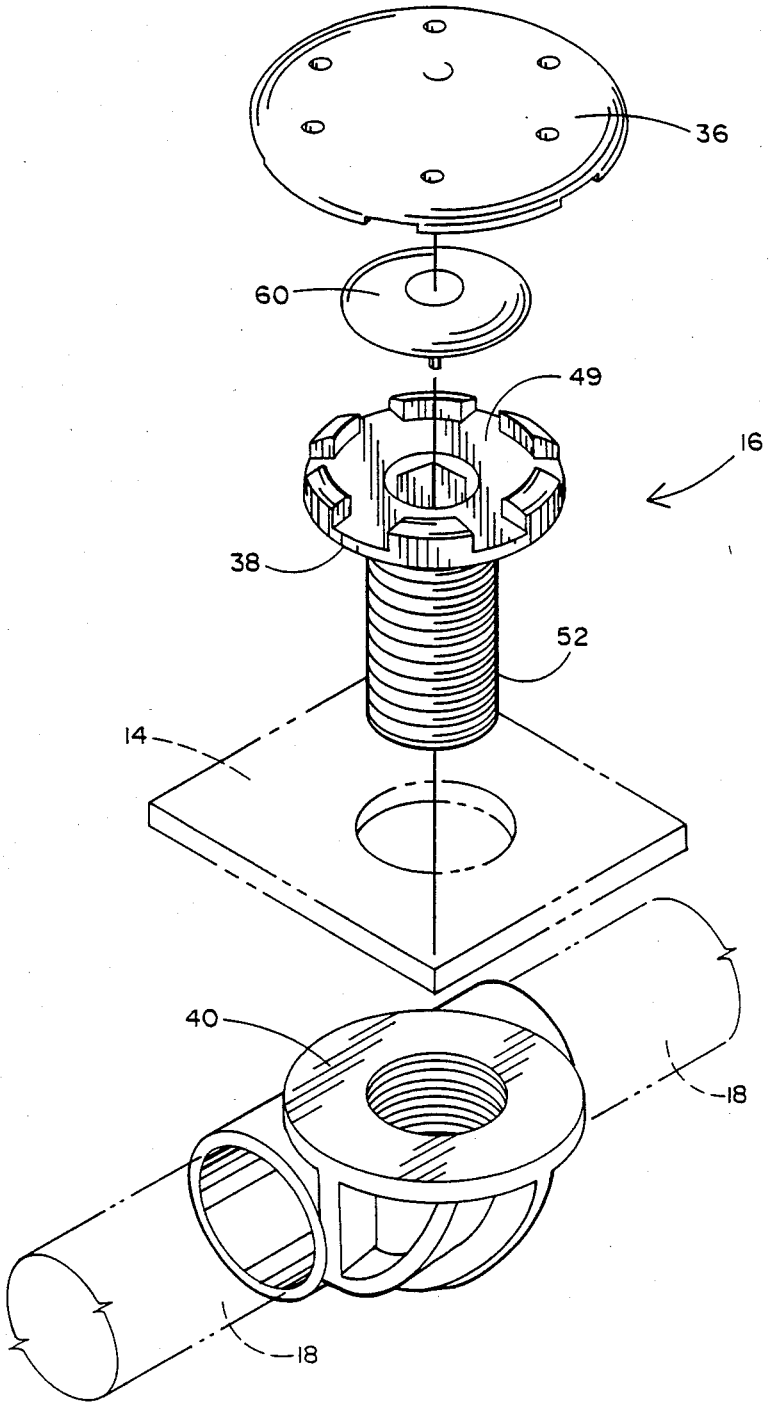
FIG. 2 is an exploded view of an individual nozzle assembly of the present invention.
Figure 9:
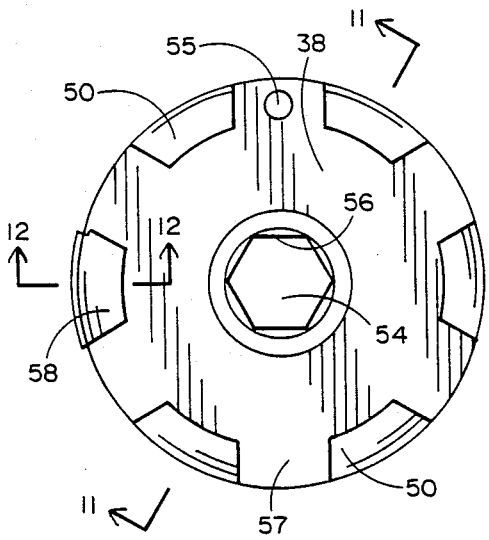
FIG. 9 is a top view of the nozzle body of the present invention.
Figure 11:
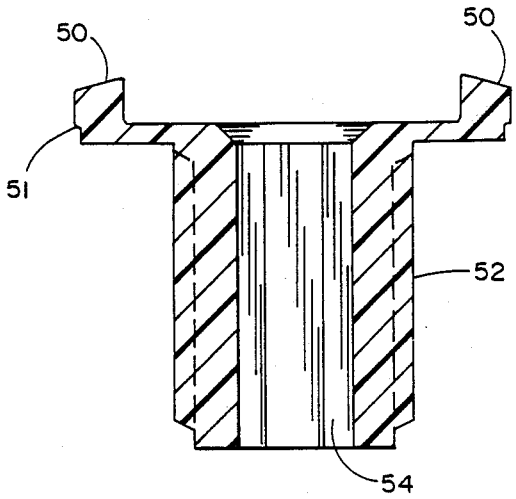
FIG. 11 is a cross-sectional view of the nozzle body of the present invention taken along lines 11—11 of FIG. 9.
Figure 10:
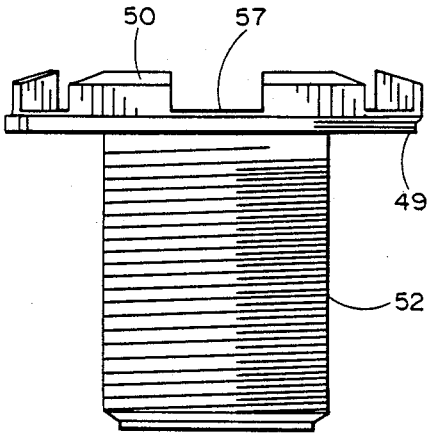
FIG. 10 is a side view of the nozzle body of the present invention.
Figure 12:
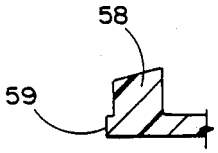
FIG. 12 is a partial cross-sectional view of a portion of the nozzle body of the present invention taken along lines 12—12 of FIG. 9.

Turning now to FIG. 2 it will be seen that each nozzle assembly 16 comprises a nozzle cap 36, a nozzle body 38 and a nozzle foot 40. In addition, an umbrella-shaped check valve 60 is positioned between the nozzle cap 36 and the nozzle body 38, in a manner to be disclosed more fully hereinafter, for the purpose of preventing water from inside the tub from entering the air control system of the present invention. It will be seen in FIG. 2 that the nozzle body 38 is designed to extend through a hole drilled into the tub floor 14 and into a nozzle foot 40 which is positioned below the tub so that the tub floor 14 is effectively sandwiched between the nozzle body and the nozzle foot. When each nozzle assembly 16 is installed in a tub floor, the only parts thereof which extend above the tub floor and are thus available inside the tub wall, are the nozzle cap 36 and that portion of the nozzle body 38 which appears castellated. In fact, it is the interaction between the nozzle cap 36 and a castellated portion 49 of nozzle body 38 which controls the air flow through each nozzle assembly in a manner to be described hereinafter. On the other hand, the nozzle foot 40 and the threaded portion 52 of nozzle body 38 reside below the tub floor 14 when the nozzle body 16 is installed. Each such nozzle foot 40, which is actually a tee, is preferably made of polyvinylchloride and interconnects half inch diameter flexible hose members 18 to the nozzle bodies on the underside of the tub floor 14. The offset configuration of the nozzle foot facilitates maximum air flow for downstream fittings while maintaining a long nozzle body grip range and low under tub profile. The unique design facilitates ease of molding with sufficient strength to support the tub in transport and to withstand a reasonable amount of abuse in transport and use. The polyvinylchloride material facilitates ease of installation.

Reference will now be made to FIGS. 3–8 which provide a more detailed description of the nozzle cap 36 of the present invention. More specifically, as shown in FIGS. 3 and 4 each nozzle cap is provided with a plurality of apertures 37 through which the air may flow in an upward direction out of each nozzle assembly 16. Each nozzle cap 36 is also provided with a plurality of slots 39 through which air may flow in a lateral direction substantially tangential to the tub floor surface. As seen best in FIGS. 4, 6 and 8, the nozzle cap 36 is provided with a very slim profile whereby to minimize any chance of possible discomfort or injury to the user. The bottom side of nozzle cap 36, that is the side facing the tub floor and generally hidden from the user, may be understood best by reference to FIGS. 5–8. In particular, as seen in those figures nozzle cap 36 comprises a plurality of symmetrically located cleats 42 and a plurality of symmetrically located snaps 44. An alignment mark 43 is also provided. The cleats 42 provide loading points against the nozzle body in the event that a side load is made to bear on the cap such as when somebody stands in the tub and applies his weight to a cap. The snaps 44 serve the multifold purpose of holding the nozzle cap 36 onto the nozzle body 38. They also preload the cap onto the body and provide a friction retention of adjustment position. The sides of the snaps 44 provide stop edges located adjacent ridges in the nozzle body thereby providing limits to cap adjustment rotation. As seen best in FIG. 5, the snaps 44 on the underside of the cap 36 are in symmetrically alternating position with respect to the cleats 42. These rigid features of the cap ride over the nozzle body head periphery in a slip fit arrangement as will be discussed hereinafter more fully below. The particular shapes of the cleats 42 and the snaps 44 are designed to enable proper mating with the underlying nozzle body 38 in a manner to be disclosed hereinafter. The inside central portion of the cap 36 is provided with a boss 46 which is designed to locate and retain the umbrella check valve 60 in the center of the nozzle assembly and to provide a preload onto this check valve for sealing it at low tub water levels.

Referring now to FIGS. 9–12 it will be seen that the nozzle body 38 of the present invention is provided with a castellated upper portion 49 and a threaded lower portion 52. The castellated upper portion 49 is provided with a plurality of symmetrically spaced air blocks 50, one of which is configured in the form of a stop lock 58 having a stop ridge 59 seen best in cross-section in FIG. 12. The threaded portion 52 of nozzle body 38 is provided with an air channel 54 the upper portion of which terminates in the plane of the castellated upper portion 49 in the form of a hex-shaped opening 56. The hex configuration of opening 56 is designed to provide easy wrench tightening of the threaded body 52 into the underlying nozzle foot 40. It will be observed that the spaces between the air blocks 50 form a plurality of air flow paths 57, the purpose and function of which will be best understood hereinafter. An alignment mark 55 is also provided in the castellated upper portion 49 of nozzle body 48. The interaction of nozzle cap 36 and nozzle body 38 as well as their combined configuration may be best understood by referring now to FIGS. 13–15 which demonstrate that adjustment is accomplished in the present invention by rotating the nozzle cap 36 on the nozzle body 38. Air flow can be modified to permit air to exit the top holes 37 of the cap 36 and/or to exit the side of the cap 36 through slots 39. The adjustment may also produce a shut off configuration or substantially full shut off so that the user can stop or substantially reduce the air flow out of some nozzle assemblies while increasing the air flow out of others.

Figure 13:
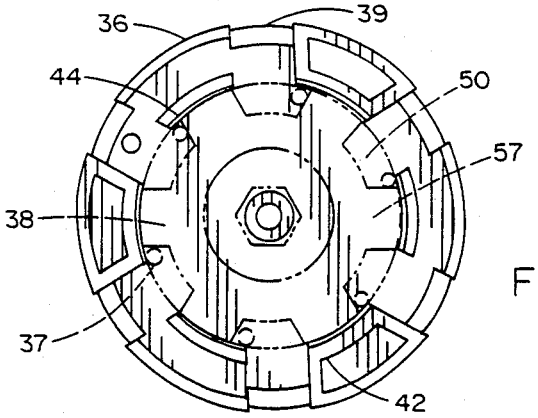
FIGS. 13 and 14 illustrate the interaction between the nozzle cap and nozzle body of the present invention and different air flow characteristics thereof.
Figure 14:
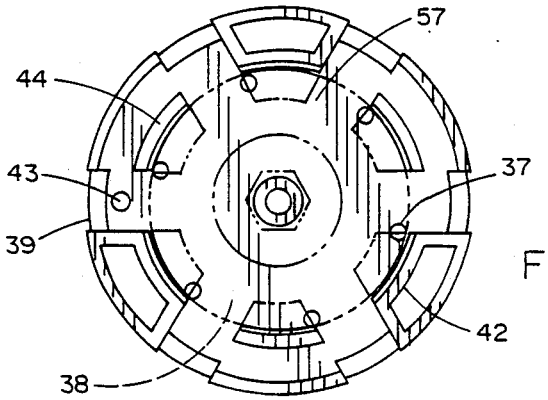
Figure 15:
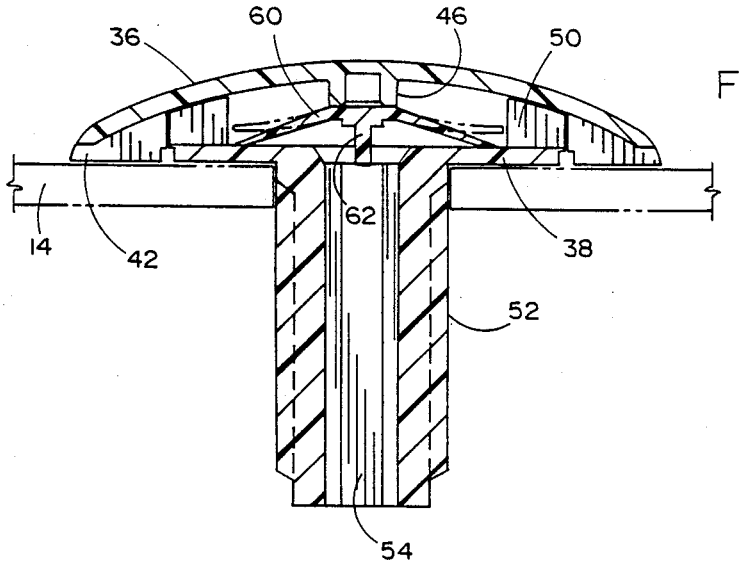
FIG. 15 is a cross-sectional view of the nozzle cap and nozzle body of the present invention.

FIG. 13 represents the configuration of nozzle cap 36 and nozzle body 38 when the nozzle assembly is in its shut off configuration. More specifically, referring to FIG. 13 it will be seen that the relative rotational positions of the cap 36 and the body 38 are such that the air blocks 50 are positioned over the holes 37 and simultaneously are positioned to block the side air slots 39. Simultaneously, each of the air flow paths 57 of the body 38 is interrupted either by a cleat 42 or a snap 44. Accordingly, in the relative rotational positions of the nozzle cap and body of FIG. 13 there is little or no air flow through that particular nozzle assembly. On the other hand, the relative position of the cap and body of FIG. 14 positions the air blocks 50 so that they cover only a portion of the apertures 37 and further so that they do not block the slots 39. In this particular configuration, while the predominant air flow is through slots 39, a limited air flow may also exit the apertures 37. It will be understood that slightly additional counterclockwise rotation of cap 36 relative to body 38 from the position shown in FIG. 14, would permit full air flow through apertures 37 and substantially full air flow through slots 39. Thus it can be seen by virtue of FIGS. 13 and 14 that there is a range of full adjustment from substantially no air flow to full air flow provided by the novel design of the present invention. FIG. 15 provides a side cross-sectional view of the interconnected body and cap relative to the tub floor 14. As seen in this particular figure, the cap 36 and castellated body portion 49 are interconnected in relative rotational engagement so that the user may rotate the cap 36 in the manner illustrated in FIGS. 13 and 14 to achieve the variation in air flow to obtain the desired adjustment thereof for each nozzle assembly. As further seen in FIG. 15, the umbrella-shaped check valve 60 is positioned between the cap 36 and the body 38 to prevent water from flowing back through the air channel 54 while still allowing air to exit the air channel 54 in the manner illustrated in phantom in FIG. 15. A deflector 62 deflects the air through channel 54 in such a manner that it raises the annular periphery of the check valve 60 to permit the air to exit through the cap 36. The center of the check valve 60 rests against the boss 46 provided at the inside center of the cap 36. While the cap 36 is rotational in its configuration on the body 38, it is nevertheless not easily removed therefrom by virtue of the annular recess 51 on the stops 50 of the castellated portion 49 of the body 38, which are adapted to receive a ridge 45 on the snaps 44 of cap 36 as seen best in FIG. 6. Limitation of adjustability, which is a preferable characteristic, is provided by the interaction of a ridge 59 on stop block 58 of the body 38 and an annular recess 47 on each of the cleats 42 as seen best in FIG. 7.

Figure 16:
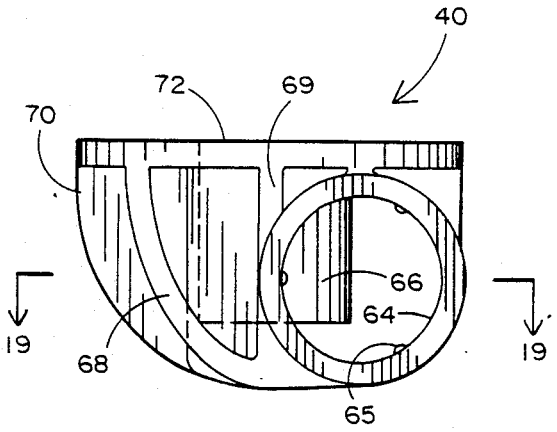
FIG. 16 is a side view of the nozzle foot of the invention.

The threaded portion 52 of each nozzle body 38, extends through an aperture drilled into the floor 14 of tub 12 where it is received by the nozzle foot 40. Each nozzle foot 40 is characterized by a pair of interconnect ports 64 which form opposite ends of an integral pipe or cylinder and which provide means for interconnecting the nozzle assembly 16 in a serial configuration by means of flex hoses 18 as seen best in FIG. 1. Each such port is provided with a number of hose stops 65 which prevent damage to the interior of the nozzle foot 40. Each nozzle foot is provided with a nozzle body threaded receptacle 66 which may be seen best in FIG. 16. This threaded receptacle is designed to mate with the threaded portion 52 of a nozzle body and is basically a hollow cylinder open at the bottom end to permit free flow of air from the interconnecting hose 18 through the port 64 and the receptacle 66 and up through the nozzle body 38.

Figure 17:
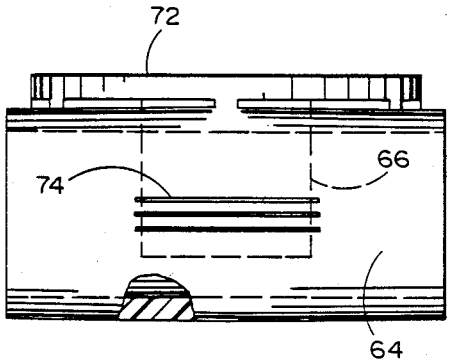
FIG. 17 is a side view partially broken away of the nozzle foot of the present invention.
Figure 19:
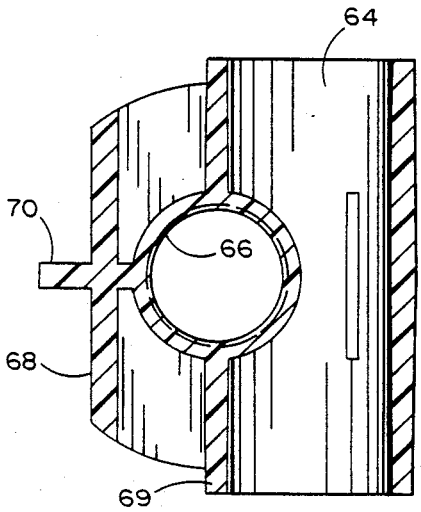
FIG. 19 is a cross-sectional view of the nozzle foot taken along lines 19—19 of FIG. 16.
Figure 18:
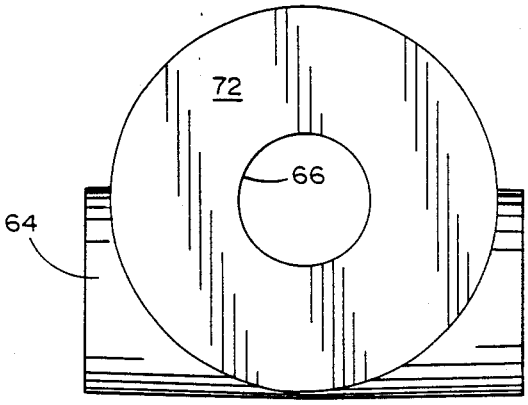
FIG. 18 is a top view of the nozzle foot of the present invention.

Each nozzle foot 40 is preferably made of a polyvinylchloride material and is preferably provided with a plurality of ribs such as ribs 68, 69 and 70 to increase the compressive strength thereof. The top of the nozzle foot 40 is provided with a flat, circular, tub-engagement surface 72 which is designed to engage the bottom outside surface of the tub floor 14 when fully threaded onto the threaded portion 52 of nozzle body 38. In this manner, the nozzle assembly 16 is securely attached to the tub floor surface 14 by compressively engaging the tub surface between the surface 72 of nozzle foot 40 and the lower portion of castellated portion 49 of nozzle body 38. In the particular embodiment illustrated in FIG. 17, the nozzle foot 40 is provided with a plurality of depth lines 74 to facilitate installation by indicating cutting limits. As shown in FIG. 1, when the nozzle foot 40 is the last in a series array of nozzle assemblies 16, its port 64 pointing away from the source of air is preferably provided with a cap 17 so that all of the air flow or substantially all of the air flow is forced up into the bathtub through the water therein.

It will now be understood that what has been disclosed herein comprises a novel air excitation bath system designed to produce a hydromassage effect in, for example, an ordinary bathtub. The system utilizes an air control serial array of adjustable nozzle assemblies preferably installed on the bottom of the tub to provide the user with means for adjusting the rate and direction of the air flow through the water to massage different parts of the body. The air control system is characterized by at least one and preferably two or more serial arrays of adjustable nozzle assemblies. Each such array is serially interconnected by a plurality of flexible hoses. The respective arrays are interconnected, preferably to a common flexible hose which is in turn connected to an air blower through at least one safety loop and a check valve. The air blower may be controlled by a control apparatus designed to respond to a pneumatic activator connected at the wall of the tub so that the user can turn the system on or off without risk of electric shock. Each nozzle assembly of the present invention is provided with a cap, a body and a foot as well as an additional check valve located between the cap and the body. The cap and the body are specially configured to permit adjustability of air flow from either substantially off to substantially full flow and also provide means for directing air flow laterally along the surface of the floor of the tub and/or vertically toward the top surface of the water. An especially novel feature of the present invention is the design of a nozzle foot which is positioned beneath the tub floor and is provided with a unique low profile configuration to substantially minimize the space required beneath the tub surface in order to interconnect the nozzle assemblies to one another and to the blower. The present invention provides a unique air injection hydromassage system which is easy to install and which uses a few, simple, low cost components while at the same time providing certain advantageous adjustability features more conventionally found in whirlpool bath-type hydromassage systems of the prior art which are inherently more complicated and more costly than the air injection system of the present invention.

Those having skill in the art to which the present invention pertains will now, as a result of the applicants' teaching herein, perceive various modifications and additions which may be made to the invention. By way of example, the number of nozzle assemblies, their relative position in the tub floor and the direction and control of air flow may be readily modified as compared to the preferred embodiment shown herein. Accordingly, it will be understood that all such modifications and additions are deemed to be within the scope of the invention which is to be limited only by the claims appended hereto.

We claim:

1. An air bubble only injection water agitation system comprising at least one air nozzle assembly having means for connection to a source of air pressure, means for directing said air pressure into a water-filled bathtub and means for controlling the flow intensity and direction of air through said water, said connection means, said directing means and said controlling means being serially interconnected for channelling air from said pressure source into said bathtub;

said connection means comprising a hose and a nozzle foot connected to said hose;

said directing means comprising a threaded tubular member extending through an aperture in the wall of said bathtub; and said controlling means comprising a nozzle cap and a nozzle body, said cap having radially-directed slots and having apertures, said body having air flow blocks, said cap and said body being rotatably interconnected on the inside surface of said tub wall adjacent said tub wall aperture, the relative rotational position of said cap slots and apertures and said body flow blocks determining the intensity and direction of air flow into said bathtub water.

2. The system recited in claim 1 wherein depending upon the relative rotational position of said cap and said body, air flow may be alternatively directed through said slots, said cap apertures, or both of said slots and cap apertures.

3. The system recited in claim 1 wherein depending upon the relative rotational position of said cap and said body, air flow may be varied continuously from substantially full on to substantially full off.

4. The system recited in claim 1 comprising a serially connected array of said air nozzle assemblies in dispersed preselected locations about said body of water.

5. The system recited in claim 1 wherein said nozzle foot is vertically dimensioned to receive said hose and is not substantially greater in height than the diameter of said hose.

6. The system recited in claim 1 wherein each such nozzle assembly comprises a check valve for preventing water from entering said hose.

7. The system recited in claim 1 wherein each said nozzle assembly controlling means comprises means for directing air flow in either of two distinct directions.

8. The system recited in claim 7 wherein one of said directions is substantially vertical and the other of said directions is substantially horizontal.

* * * * *